US009306281B2

(12) United States Patent
Chang et al.

(10) Patent No.: US 9,306,281 B2
(45) Date of Patent: Apr. 5, 2016

(54) WIRELESS COMMUNICATION DEVICE

(71) Applicant: Acer Incorporated, New Taipei (TW)

(72) Inventors: Kun-Sheng Chang, New Taipei (TW); Ming-Yu Chou, New Taipei (TW); Ching-Chi Lin, New Taipei (TW)

(73) Assignee: Acer Incorporated, New Taipei (TW)

( * ) Notice: Subject to any disclaimer, the term of this patent is extended or adjusted under 35 U.S.C. 154(b) by 89 days.

(21) Appl. No.: 14/195,861

(22) Filed: Mar. 4, 2014

(65) Prior Publication Data

US 2015/0188223 A1 Jul. 2, 2015

(30) Foreign Application Priority Data

Dec. 31, 2013 (TW) ..... 102149314 A

(51) Int. Cl.
*H01Q 5/314* (2015.01)
*H01Q 5/00* (2015.01)

(52) U.S. Cl.
CPC ..... *H01Q 5/0034* (2013.01); *H01Q 5/314* (2015.01)

(58) Field of Classification Search
USPC ..... 343/702, 722
See application file for complete search history.

(56) References Cited

U.S. PATENT DOCUMENTS

| | | | | |
|---|---|---|---|---|
| 5,841,407 | A * | 11/1998 | Birnbaum | 343/895 |
| 6,642,895 | B2 * | 11/2003 | Zurcher et al. | 343/718 |
| 6,812,892 | B2 | 11/2004 | Tai et al. | |
| 7,102,586 | B2 * | 9/2006 | Liang et al. | 343/795 |
| 2014/0292602 | A1 * | 10/2014 | Suzuki et al. | 343/749 |

FOREIGN PATENT DOCUMENTS

| | | | |
|---|---|---|---|
| JP | 2013110624 A | * | 6/2013 |
| WO | 2013076894 | | 5/2013 |

* cited by examiner

*Primary Examiner* — Howard Williams
(74) *Attorney, Agent, or Firm* — Jianq Chyun IP Office

(57) ABSTRACT

A wireless communication device including an antenna element and a resonant divider is provided. The antenna element has a resonant path so that an operation frequency of the antenna element covers a first band and a second band. The resonant divider is electrically connected to the antenna element and provides a current path connected in parallel with a part of the resonant path. The resonant divider delays a current flowing through the current path so that the antenna element is incapable of covering an interval band between the first band and the second band.

8 Claims, 2 Drawing Sheets

WIRELESS COMMUNICATION DEVICE

CROSS-REFERENCE TO RELATED APPLICATION

This application claims the priority benefit of Taiwan application serial no. 102149314, filed on Dec. 31, 2013. The entirety of the above-mentioned patent application is hereby incorporated by reference herein and made a part of this specification.

BACKGROUND

1. Technical Field

The invention relates to a wireless communication device. Particularly, the invention relates to a wireless communication device having a resonant divider.

2. Related Art

In recent years, wireless communication devices are constantly developed toward a design trend of high performance and multifunction. Therefore, the wireless communication device has to support a plurality of communication protocols, so as to provide diversified services. In order to satisfy various communication protocols, an antenna element in the wireless communication device has to be able to operate in multiple bands. For example, in $3^{rd}$ generation (3G) mobile communication, an operation frequency of the antenna element has to cover two bands of 1565-1612 MHz and 1920-2170 MHz to support a global positioning system. Moreover, an interval band, e.g. 1710-1920 MHz, between the above two bands is unnecessary to be supported in a high frequency application of the antenna element.

However, conventional techniques are generally limited by physical characteristics of the antenna, so that an operable frequency range of the antenna element is designed to be from 1565 MHz to 2170 MHz, directly. In other words, even though the interval band is unnecessary to be supported, the operable frequency range of the antenna element in the conventional techniques is still designed to cover the interval band. Therefore, the antenna element cannot have a better gain on the bands required to be supported, such that performance of the wireless communication device is influenced in an actual application.

SUMMARY

The invention is directed to a wireless communication device, in which a current path provided by a resonant divider is connected in parallel with a part of a resonant path of an antenna element. In this way, energy of the antenna element is focused on a first band and a second band to skip an interval band between the first band and the second band.

The invention provides a wireless communication device including an antenna element and a resonant divider. The antenna element has a resonant path so that an operation frequency of the antenna element covers a first band and a second band. The resonant divider is electrically connected to the antenna element and provides a current path connected in parallel with a part of the resonant path. The resonant divider delays a current flowing through the current path so that the operation frequency of the antenna element is incapable of covering an interval band between the first band and the second band.

According to the above descriptions, the antenna element of the invention has a resonant path, and the current path provided by the resonant divider is connected in parallel with a part of the resonant path. Therefore, the operation frequency of the antenna element can cover the first band and the second band without covering the interval band between the first band and the second band. In this way, the energy of the antenna element can be focused on the first band and the second band to satisfy an application demand of the wireless communication device.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF DISCLOSED EMBODIMENTS

Figure 1:
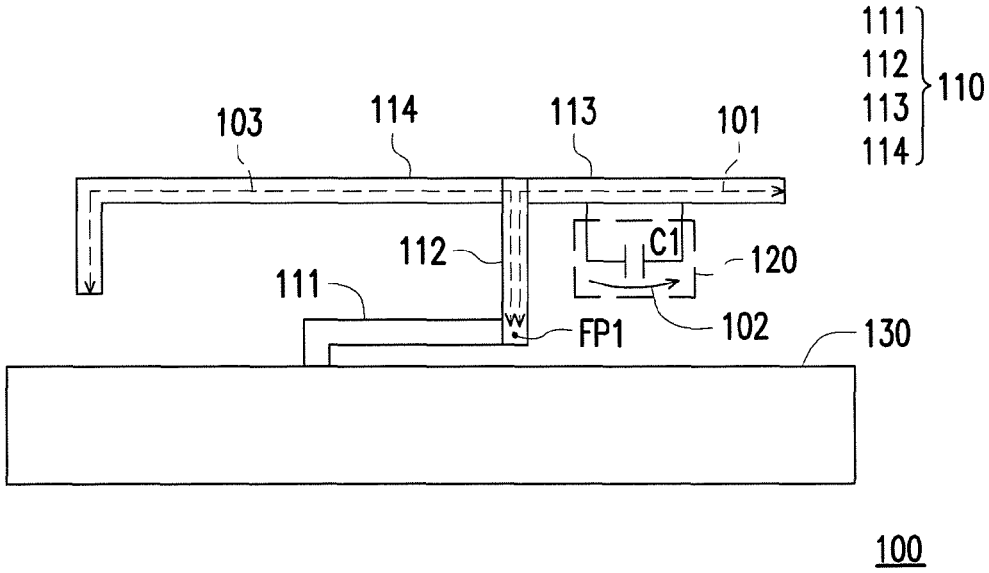
FIG. 1 is a schematic diagram of a wireless communication device according to an embodiment of the invention.

FIG. 1 is a schematic diagram of a wireless communication device according to an embodiment of the invention. As shown in FIG. 1, the wireless communication device 100 includes an antenna element 110 and a resonant divider 120. The antenna element 110 is, for example, a planar inverted-F antenna (PIFA), and the antenna element 110 includes a ground portion 111, a connection portion 112, a first extending portion 113 and a second extending portion 114.

In detail, a first terminal of the ground portion 111 is electrically connected to a ground plane 130. A first terminal of the connection portion 112 has a feed point FP1, and the first terminal of the connection portion 112 is electrically connected to a second terminal of the ground portion 111. A first terminal of the first extending portion 113 is electrically connected to a second terminal of the connection portion 112, and a second terminal of the first extending portion 113 is an open terminal. A first terminal of the second extending portion 114 is electrically connected to the second terminal of the connection portion 112, and a second terminal of the second extending portion 114 is an open terminal.

The resonant divider 120 is electrically connected to the antenna element 110, and provides a circuit path 102. It should be noticed that the connection portion 112 and the first extending portion 113 in the antenna element 110 can form a resonant path 101, and the current path 102 provided by the resonant divider 120 is connected in parallel with a part of the resonant path 101. In this way, a current flowing through the first extending portion 113 is partially diverted to the resonant divider 120.

In operation, the antenna element 110 can be operated in a first band and a second band through the resonant path 101. Namely, through the resonant path 101 of the antenna element 110, an operation frequency of the antenna element 110 covers the first band and the second band. Moreover, the resonant divider 120 delays a current flowing through the current path 102 so that the operation frequency of the antenna element 110 is incapable of covering an interval band between the first band and the second band. In other words, along with configuration of the resonant divider 120, the antenna element 110 skips the interval band that is unnecessary to be supported to focus energy on the first band and the second band. In this way, gains of the antenna element 110 operated in the first band and the second band are effectively increased.

Figure 2:
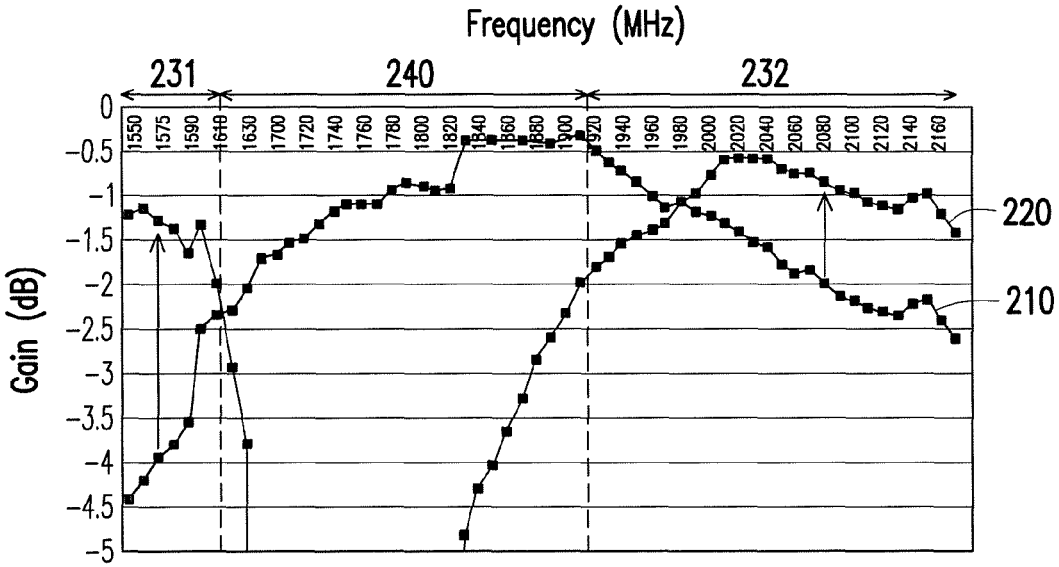
FIG. 2 is a gain diagram of an antenna element according to an embodiment of the invention.

For example, FIG. 2 is a gain diagram of the antenna element according to an embodiment of the invention. In the embodiment of FIG. 2, the antenna element 110 is applied to a 3G Aux technique. Namely, the antenna element 110 is, for example, an auxiliary antenna in $3^{rd}$ generation (3G) mobile communication, which is used for supporting a function of global positioning system (GPS) of the 3G mobile communication. In application of 3G Aux, the antenna element 110 has to be able to operate in a first band 231 (e.g. 1565-1612 MHz) and a second band 232 (e.g. 1920-2170 MHz), and an interval band 240 (e.g. 1612-1920 MHz) is unnecessary to be supported by the antenna element 110.

Moreover, in the embodiment of FIG. 2, a gain curve 210 represents gains of the antenna element 110 without the resonant divider 120, and a gain curve 220 represents gains of the antenna element 110 configured with the resonant divider 120. As shown by the gain curve 210, in case that the resonant divider 120 is not configured, the antenna element 110 has better gain on the interval band 240 that is unnecessary to be supported. Moreover, along with configuration of the resonant divider 120, the antenna element 110 can skip the interval band 240 that is unnecessary to be supported, and gains of the antenna element 110 in the first band 231 and the second band 232 are relatively increased to satisfy an application requirement of the wireless communication device 100.

Figure 3:
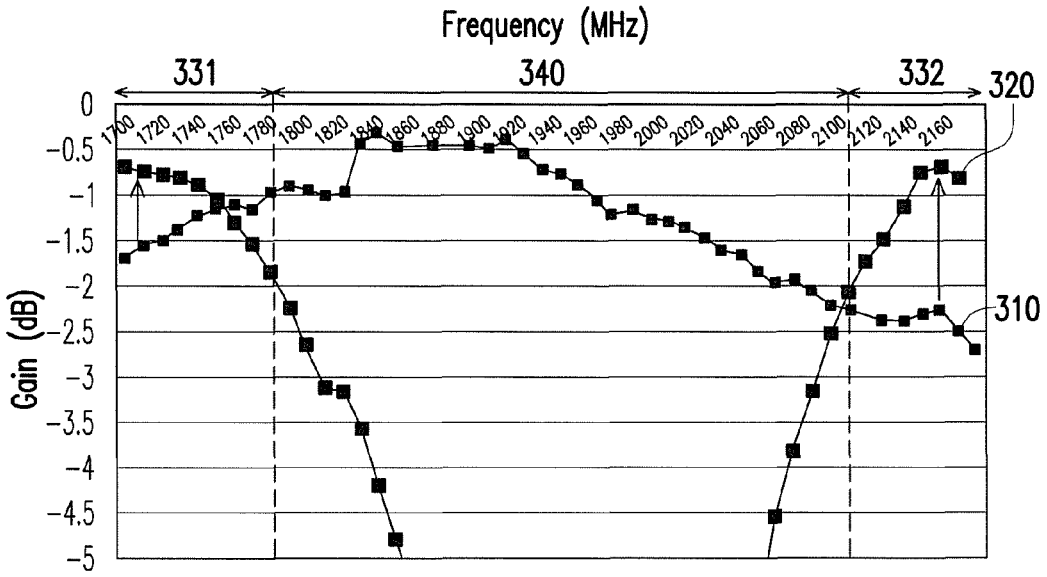
FIG. 3 is a gain diagram of an antenna element according to another embodiment of the invention.

FIG. 3 is a gain diagram of the antenna element according to another embodiment of the invention. In the embodiment of FIG. 3, the antenna element 110 is applied to a high frequency band of long term evolution (LTE). Therefore, the antenna element 110 has to be able to operate in a first band 331 (e.g. 1710-1785 MHz) and a second band 332 (e.g. 2110-2170 MHz), and an interval band 340 (e.g. 1785-2110 MHz) is unnecessary to be supported by the antenna element 110. Moreover, gain curves 310 and 320 respectively represent gains of the antenna element 110 without the resonant divider 120 and configured with the resonant divider 120. By comparing the gain curves 310 and 320, it is known that along with configuration of the resonant divider 120, the antenna element 110 can skip the interval band 340 that is unnecessary to be supported, and gains of the antenna element 110 in the first band 331 and the second band 332 are relatively increased.

Figure 4:
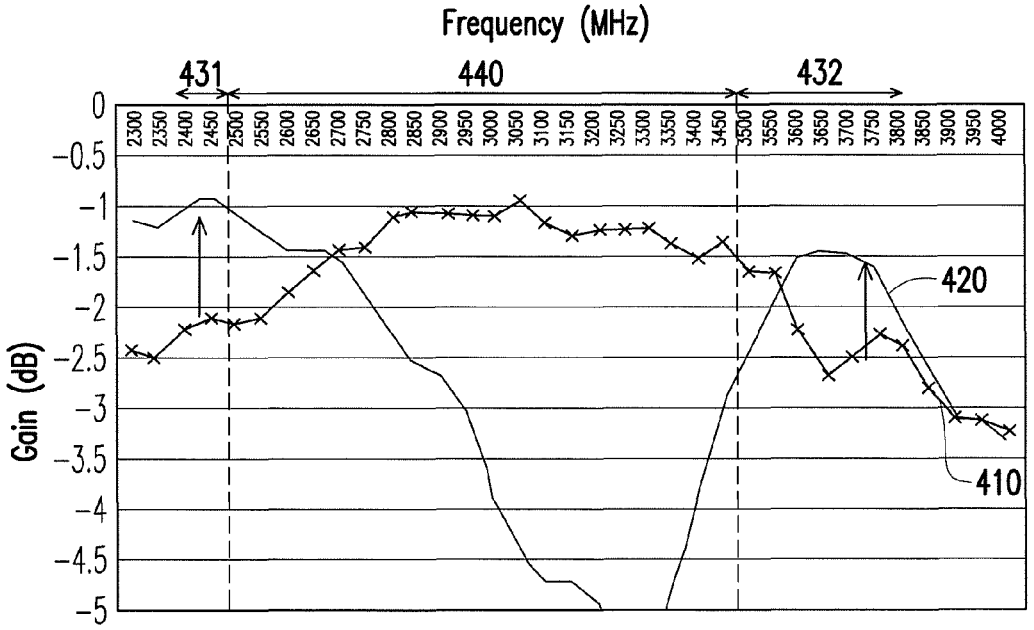
FIG. 4 is a gain diagram of an antenna element according to still another embodiment of the invention.

FIG. 4 is a gain diagram of the antenna element according to still another embodiment of the invention. In the embodiment of FIG. 4, the antenna element 110 is applied to a 3G band of a worldwide interoperability for microwave access (WiMAX) technique and a 2G band of a wireless local area network (WLAN). Therefore, the antenna element 110 has to be able to operate in a first band 431 (e.g. 2400-2500 MHz) and a second band 432 (e.g. 3500-3800 MHz), and an interval band 440 (e.g. 2500-3500 MHz) is unnecessary to be supported by the antenna element 110. Moreover, gain curves 410 and 420 respectively represent gains of the antenna element 110 without the resonant divider 120 and configured with the resonant divider 120. By comparing the gain curves 410 and 420, it is known that along with configuration of the resonant divider 120, the antenna element 110 can skip the interval band 440 that is unnecessary to be supported, and gains of the antenna element 110 in the first band 431 and the second band 432 are relatively increased.

Referring to FIG. 1, the connection portion 112 and the second extending portion 114 in the antenna element 110 can form another resonant path 103. Moreover, the antenna element 110 can be operated in a third band through the resonant path 103. Namely, the antenna element 110 is further operated in the third band through the second extending portion 114 and the connection portion 112. Moreover, the resonant divider 120 includes a capacitor element C1, and the capacitor element C1 is connected in parallel with a part of the first extending portion 113. In the embodiment of FIG. 1, a length of the resonant path 103 formed by using the second extending portion 114 is greater than a length of the resonant path 101. Therefore, a frequency of the third band is lower than frequencies of the first band and the second band.

It should be noticed that in another embodiment, the length of the resonant path 103 formed by using the second extending portion 114 can also be smaller than the length of the resonant path 101. Now, the frequency of the third band is greater than the frequencies of the first band and the second band. Moreover, when the frequency of the third band is lower than the frequencies of the first band and the second band, a capacitance of the capacitor element C1 is, for example, between 0.1 pF(picofarad) and 3 pF. Moreover, when the frequency of the third band is greater than the frequencies of the first band and the second band, the capacitance of the capacitor element C1 is, for example, between 3 pF and 8 pF.

In other words, in an actual application, the capacitance of the capacitor element C1 is inversely proportional to the frequency of the second band of the antenna element 110. For example, regarding the embodiments of FIG. 2 to FIG. 4, when the antenna element 110 is applied to 3G Aux, WiMAX or a high frequency band of LTE, the frequency of the second band is greater than 1.9 GHz, and now the capacitance of the capacitor element C1 is between 0.1 pF and 3 pF. Comparatively, when the frequency of the second band is smaller than 1.9 GHz, the capacitance of the capacitor element C1 is accordingly increased, for example, the capacitance of the capacitor element C1 is between 3 pF and 8 pF.

Besides, although an implementation of the antenna element 110 is provided in the embodiment of FIG. 1, the invention is not limited thereto. For example, those skilled in the art can implement the antenna element 110 by using a monopole antenna, a dipole antenna or a loop antenna according to a design requirement, and connect the current path 102 of the resonant divider 120 to a resonant path of the monopole antenna, the dipole antenna or the loop antenna. In this way, along with configuration of the resonant divider 120, the monopole antenna, the dipole antenna or the loop antenna may have better gains on the bands to be supported, so as to satisfy the application requirement of the wireless communication device 100.

In summary, the antenna element of the invention has a resonant path, and the current path provided by the resonant divider is connected in parallel with a part of the resonant path. Therefore, the operation frequency of the antenna element can cover the first band and the second band without covering the interval band between the first band and the second band. In this way, in actual applications, the energy of the antenna element can be focused on the first band and the second band required to be supported and skip the interval band that is unnecessary to be supported.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A wireless communication device, comprising:

an antenna element, comprising a connection portion and a first extending portion connected with each other, wherein the connection portion has a feed point, the connection portion and the first extending portion form a resonant path, and the antenna element is operated in a first band and a second band through the resonant path; and a resonant divider, electrically connected in parallel with a part of the first extending portion, and providing a current path connected in parallel with a part of the resonant path, wherein the resonant divider delays a current flowing through the current path, and the antenna element is incapable of being operated in an interval band between the first band and the second band in response to the delay of the current flowing through the current path.

2. The wireless communication device as claimed in claim 1, wherein the resonant divider comprises a capacitor element.

3. The wireless communication device as claimed in claim 2, wherein the antenna element is a planar inverted-F antenna, and the antenna element further comprises:

a ground portion, having a first terminal electrically connected to a ground plane, wherein a first terminal of the connection portion is electrically connected to a second terminal of the ground portion, a first terminal of the first extending portion is electrically connected to a second terminal of the connection portion, and a second terminal of the first extending portion is an open terminal.

4. The wireless communication device as claimed in claim 3, wherein the antenna element further comprising:

a second extending portion, having a first terminal electrically connected to the second tenninal of the connection portion, and a second terminal being an open terminal, wherein the antenna element is further operated in a third band through the second extending portion and the connection portion.

5. The wireless communication device as claimed in claim 4, wherein when a frequency of the third band is lower than frequencies of the first band and the second band, a capacitance of the capacitor element is between 0.1 pF and 3 pF.

6. The wireless communication device as claimed in claim 4, wherein when a frequency of the third band is greater than frequencies of the first band and the second band, a capacitance of the capacitor element is between 3 pF and 8 pF.

7. The wireless communication device as claimed in claim 1, wherein a capacitance of the capacitor element is inversely proportional to a frequency of the second band.

8. The wireless communication device as claimed in claim 1, wherein the antenna element is a planar inverted-F antenna (PIFA), a monopole antenna, a dipole antenna or a loop antenna.

* * * * *